US010155635B2

(12) United States Patent
Suzuki

(10) Patent No.: US 10,155,635 B2
(45) Date of Patent: Dec. 18, 2018

(54) SHEET DETECTING DEVICE AND IMAGE FORMING APPARATUS

(71) Applicant: CANON KABUSHIKI KAISHA, Tokyo (JP)

(72) Inventor: Takafumi Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/704,255

(22) Filed: Sep. 14, 2017

(65) Prior Publication Data

US 2018/0081314 A1 Mar. 22, 2018

(30) Foreign Application Priority Data

Sep. 20, 2016 (JP) ..... 2016-182725

(51) Int. Cl.
*B65H 7/02* (2006.01)
*G03G 15/00* (2006.01)
*B65H 7/14* (2006.01)

(52) U.S. Cl.
CPC ..... *B65H 7/02* (2013.01); *B65H 7/14* (2013.01); *G03G 15/5004* (2013.01);
(Continued)

(58) Field of Classification Search
CPC ... B65H 7/02; B65H 7/04; B65H 7/06; B65H 7/14; B65H 7/20; B65H 2511/51; B65H 2511/515; B65H 2553/41; B65H 2553/412; B65H 2553/414; B65H 2553/416; B65H 2553/44; B65H 2553/61; B65H 2553/612; B65H 2553/80; B65H 2553/82; B65H 2553/822; G03G 2215/00611; G03G 2215/00616; G03G 2215/00628
See application file for complete search history.

(56) References Cited

U.S. PATENT DOCUMENTS 5,139,339 A * 8/1992 Courtney ..... B41J 11/009 250/341.8
5,652,943 A * 7/1997 Matsuo ..... B65H 5/00 399/21
(Continued)

FOREIGN PATENT DOCUMENTS

JP 08-137340 A 5/1996
JP 2007-223736 A 9/2007
(Continued)

*Primary Examiner* — Ernesto A Suarez
(74) *Attorney, Agent, or Firm* — Venable LLP

(57) ABSTRACT

A sheet detecting device usable with a sheet feeding device for feeding a sheet, the sheet detecting device includes a common light emitter; a first light receptor and a second light receptor for receiving the light emitted by the common light emitter and output a signal in response to the reception of the light; a first detector configured to detect presence or absence of the sheet by switching the signal outputted by light receptor, in response to the sheet blocking or reflecting the light emitted by the common light emitter; a movable portion capable of being moved by the sheet which is moving; and a second detector configured to detect presence or absence of the sheet by switching the signal outputted by the second light receptor, in response to the movable portion forming or blocking a optical path for the light emitted by the common light emitter.

5 Claims, 13 Drawing Sheets

(52) U.S. Cl.
CPC ..... *G03G 15/6511* (2013.01); *B65H 2511/10* (2013.01); *B65H 2511/51* (2013.01); *B65H 2511/515* (2013.01); *B65H 2553/414* (2013.01); *B65H 2553/612* (2013.01); *B65H 2557/10* (2013.01); *G03G 15/6502* (2013.01); *G03G 2215/00616* (2013.01); *G03G 2215/00628* (2013.01); *G03G 2215/00721* (2013.01); *G03G 2215/0453* (2013.01)

(56) References Cited

U.S. PATENT DOCUMENTS

| | | | | |
|---|---|---|---|---|
| 5,999,760 | A | 12/1999 | Suzuki et al. | |
| 6,168,270 | B1 | 1/2001 | Saikawa et al. | |
| 6,215,552 | B1 * | 4/2001 | Acquaviva | G01B 11/0608 356/601 |
| 6,794,633 | B2 * | 9/2004 | Iwasaki | B65H 7/14 250/221 |
| 7,018,121 | B2 * | 3/2006 | Barry | B41J 11/009 250/239 |
| 7,354,034 | B2 | 4/2008 | Nakamura et al. | |
| 7,543,806 | B2 | 6/2009 | Nakamura et al. | |
| 9,025,973 | B2 | 5/2015 | Suzuki et al. | |
| 2015/0028533 | A1 * | 1/2015 | Kato | B65H 7/14 271/3.16 |

FOREIGN PATENT DOCUMENTS

| | | | |
|---|---|---|---|
| JP | 2016-042102 | A | 3/2016 |
| JP | 2016-124681 | A | 7/2016 |

* cited by examiner (a)

(b)

(a)

(b)

(a)

(b)

(a)

(b)

(a)

(b)

(a)

(b)

(a)

(b)

SHEET DETECTING DEVICE AND IMAGE FORMING APPARATUS

FIELD OF THE INVENTION AND RELATED ART

The present invention relates to a sheet detecting device for detecting a sheet of recording medium, and an image forming apparatus such as an electrophotographic copying machine, an electrophotographic printing machine, an inkjet printing machine that is equipped with a sheet detecting device.

Generally speaking, an image forming apparatus such as a copying machine is required to accurately detect the presence or absence of sheets of recording medium of various types in specific areas of the apparatus, while the sheets are conveyed through the image forming apparatus.

In Japanese Laid-open Patent Application No. 2007-223736, a sheet detecting device configured so that it uses a combination of an optical sensor of the so-called flag type, and an ordinary optical sensor, that is, an optical sensor which does not employ a flag, to detect the presence or absence of a sheet of recording medium, is disclosed. More concretely, when ordinary paper or the like that is likely to block light is used as recording medium, it uses such an optical sensor that is configured so that when a sheet is present, the light emitted from its light emitting portion is blocked or reflected by the sheet, and therefore, the signals outputted by its light sensing portion change to indicate the presence of the sheet. On the other hand, a sheet of recording medium, through which light easily transmits, is used as recording medium, an optical sensor of the flag type, which employs a combination of a flag and a photo-interrupter, is used.

An optical sensor of the flag type is configured so that the presence of a sheet is detected by the rotational movement of a flag, which is caused by the contact between the sheet and flag, and the subsequent rotational movement of the flag. Therefore, if sheet interval is small, or in the like situation, it is possible that a flag will fail to return from the position in which the flag detects a sheet, to the position in which it remains on standby. That is, it is possible that the length of time it takes for a flag to respond sometimes becomes an issue. In comparison, in terms of response time, an ordinary optical sheet sensor, or an optical sensor of the flag-less type, is superior to an optical sensor of the flag type. However, when transparent paper for OHP, or the like, is used as recording medium, it is sometimes impossible to accurately detect the presence or absence of the sheet with the use of an ordinary optical sheet sensor, because the transparent paper for OHP or the like, which easily transmits light, is small in the amount by which it reflects light, that is, it is large in the amount by which it transmits light. Therefore, the employment of a combination of the above-described two types of sensor makes it possible to accurately detect the presence or absence of a sheet, regardless of the type of the sheet which is being conveyed through the image forming apparatus.

In the image forming apparatus market, it has been desired to reduce an image forming apparatus in size and electric power consumption. In the case of the image forming apparatus disclosed in Japanese Laid-open Patent Application No. 2007-223736, however, the apparatus is configured so that the optical sensor of the flag type and optical sensor of the flag-less type are independently disposed from each other. Thus, the two sensors require their own space, making it difficult to reduce the image forming apparatus (sheet detecting device) in size. Further, with the employment of two sensors, the image forming apparatus is likely to be greater in electric power consumption. In other words, the configuration for a sheet detecting device, which is disclosed in Japanese Laid-open Patent Application No. 2007-223736 is possibly adverse to the effort to reduce an image forming apparatus (sheet detecting device) in electrical power consumption.

SUMMARY OF THE INVENTION

The present invention was made in consideration of the above-described present state of the image forming apparatus market. Thus, the primary object of the present invention is to provide a sheet detecting device which is not only capable of more accurately detecting a sheet of recording medium regardless of sheet type, but also, substantially smaller in size and electric power consumption than any conventional sheet detecting device.

According to an aspect of the present invention, there is provided a sheet detecting device usable with a sheet feeding device for feeding a sheet, said sheet detecting device comprising a common light emitter; a first light receptor and a second light receptor configured to receive the light emitted by said common light emitter and output a signal in response to the reception of the light; a first sheet detector configured to detect presence or absence of the sheet by switching the signal outputted by light receptor, in response to the sheet blocking or reflecting the light emitted by said common light emitter; a movable portion capable of being moved by the sheet which is moving; and a second sheet detector configured to detect presence or absence of the sheet by switching the signal outputted by said second light receptor, in response to said movable portion forming or blocking a optical path for the light emitted by said common light emitter.

Further features of the present invention will become apparent from the following description of exemplary embodiments with reference to the attached drawings.

Figure 2:
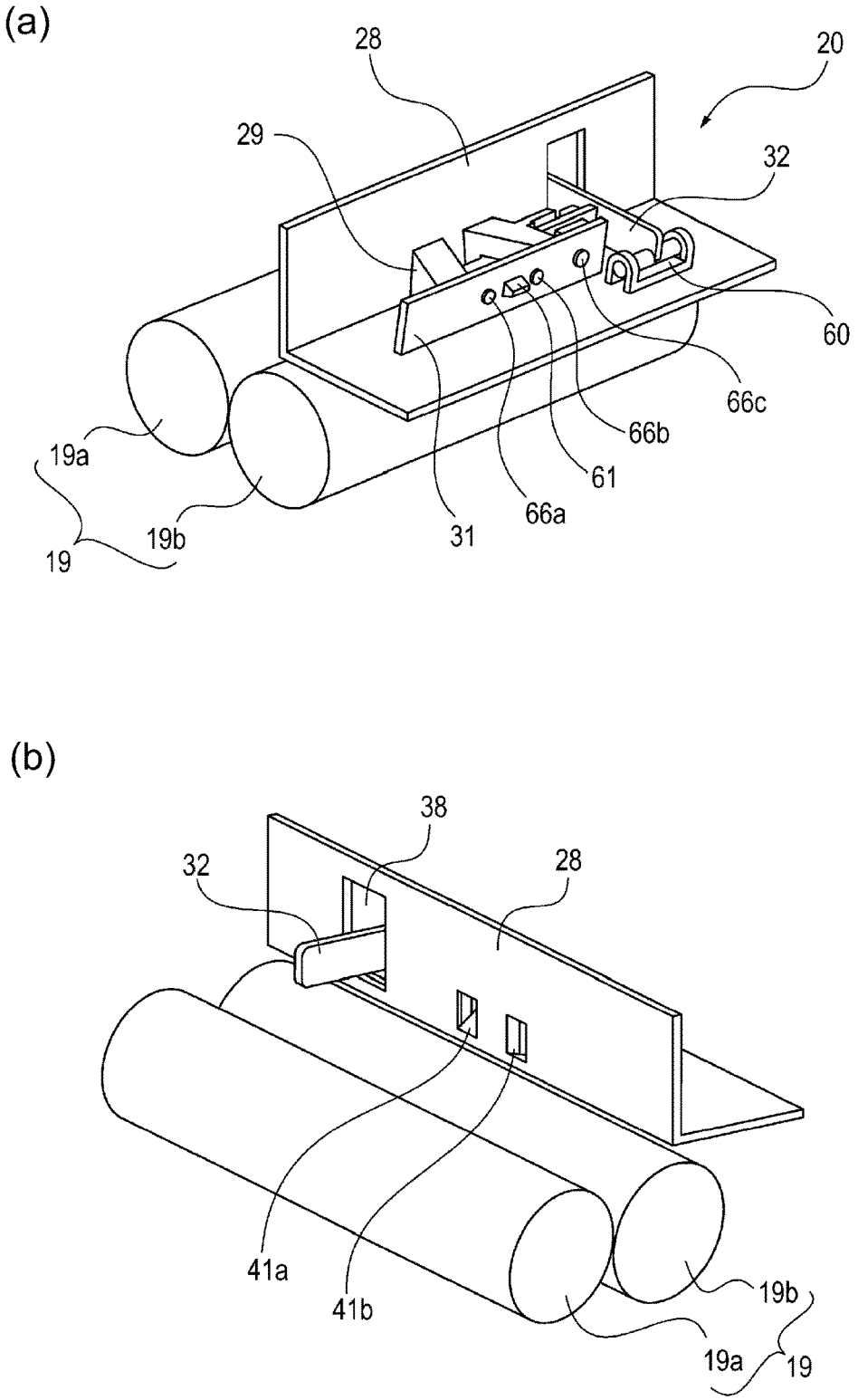

Parts (a) and (b) of FIG. 2 are schematic perspective views of the sheet detecting device in the first embodiment of the present invention.

Figure 3:
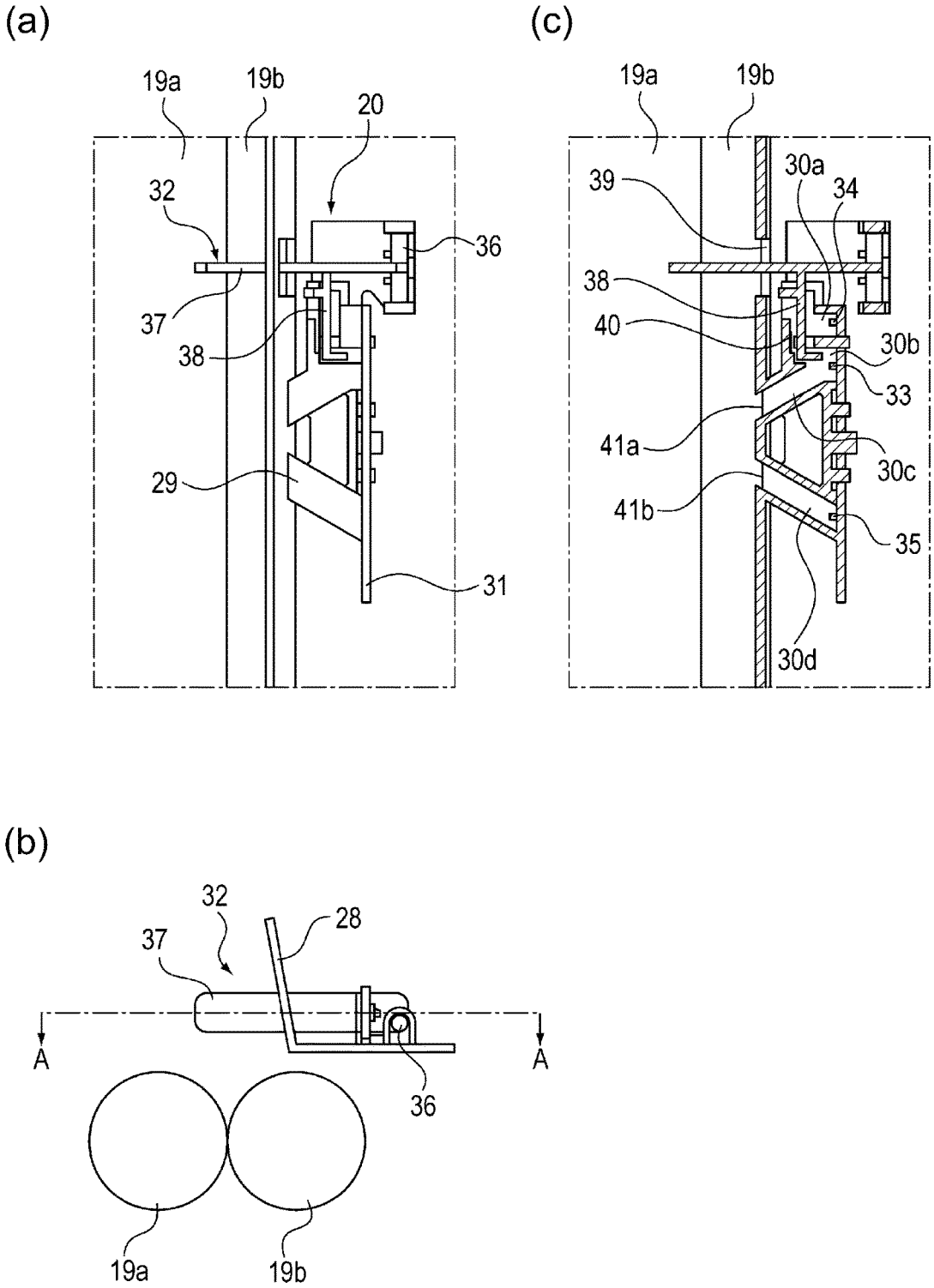

Parts (a), (b) and (c) of FIG. 3 are a combination of top, side, and sectional views of the sheet detecting device.

Figure 4:
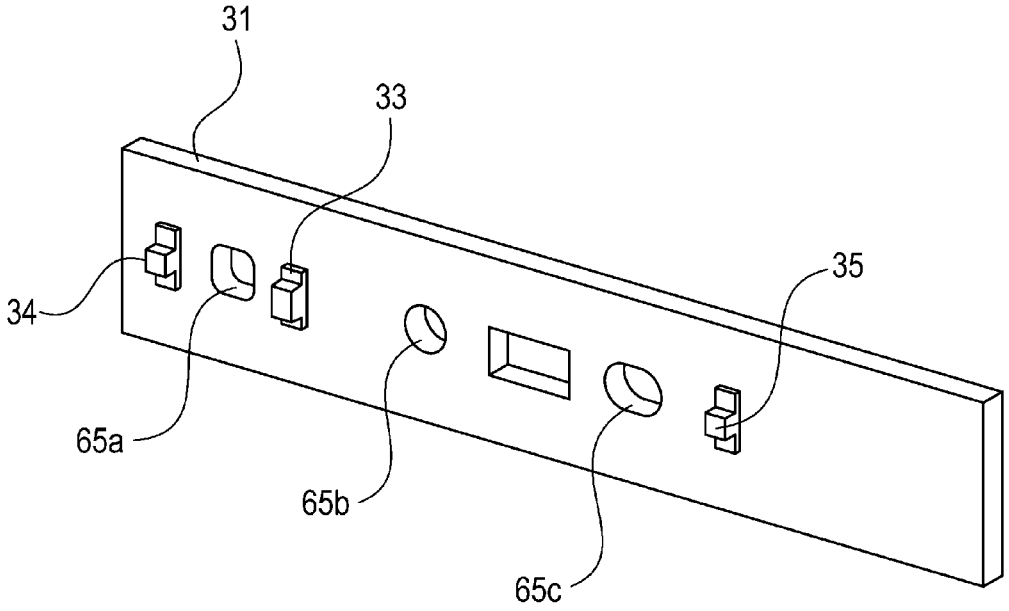

FIG. 4 is a schematic perspective view of the substrate of the sheet detecting device.

Figure 5:
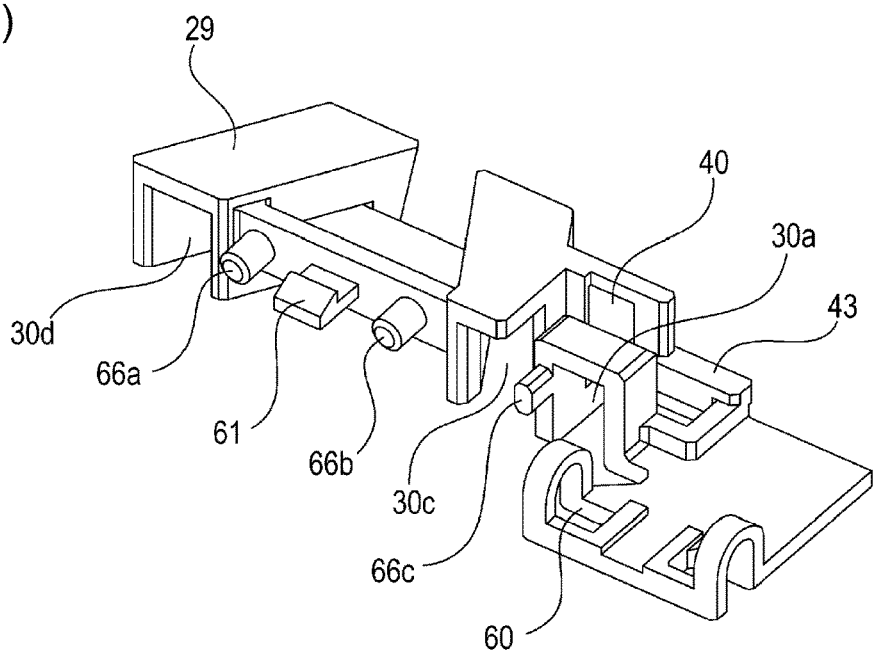
Figure 5:
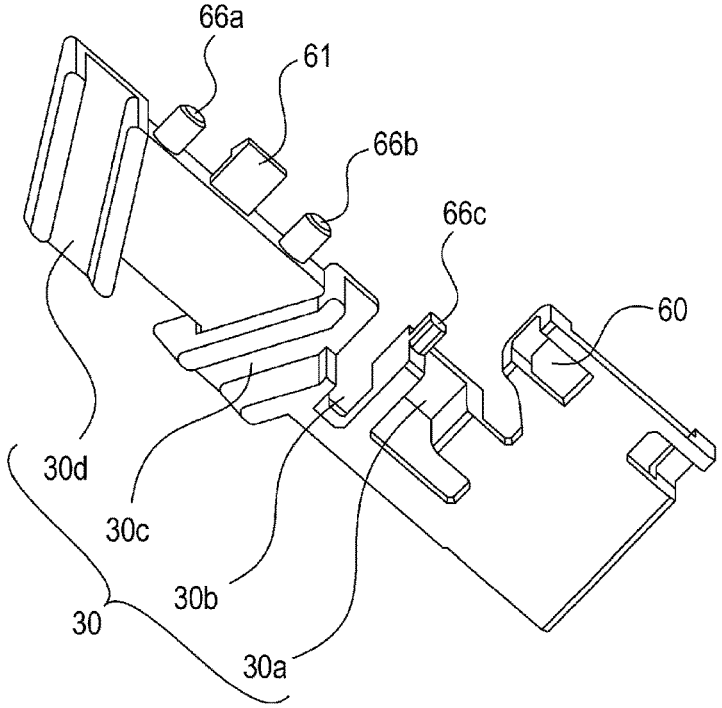

Parts (a) and (b) of FIG. 5 are schematic perspective views of the sensor holding plate.

Figure 6:
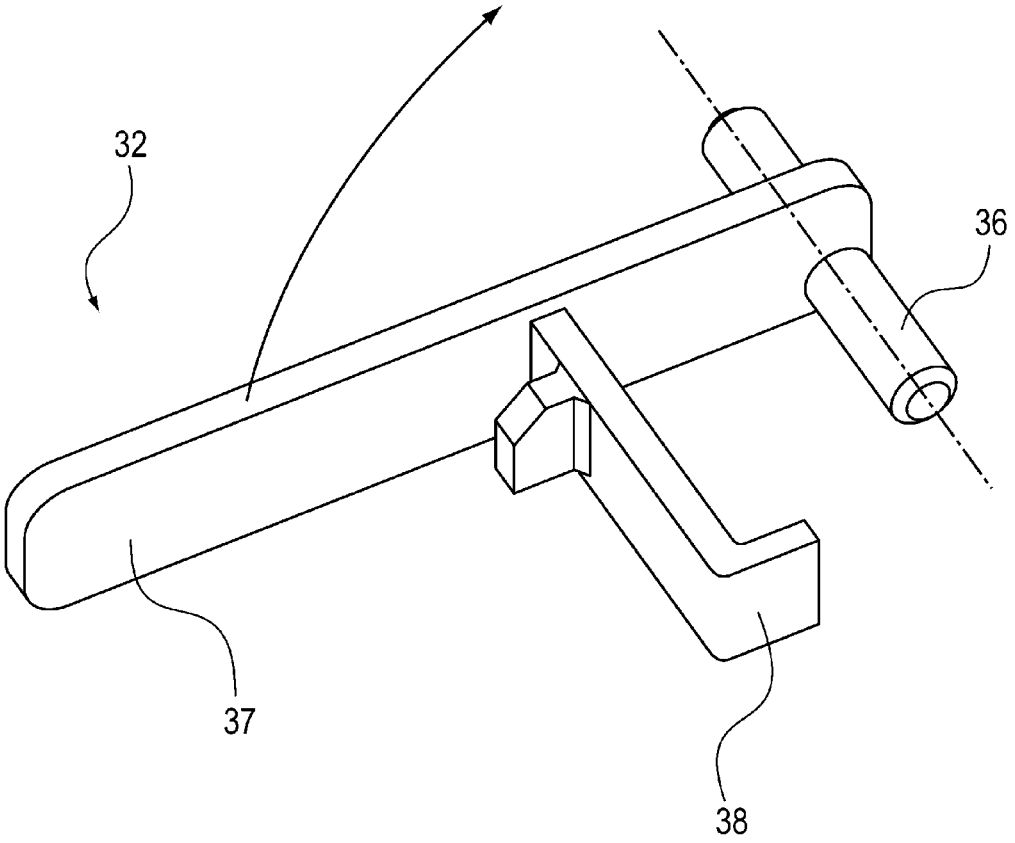

FIG. 6 is a schematic perspective view of the flag of the sheet detecting device.

Figure 7:
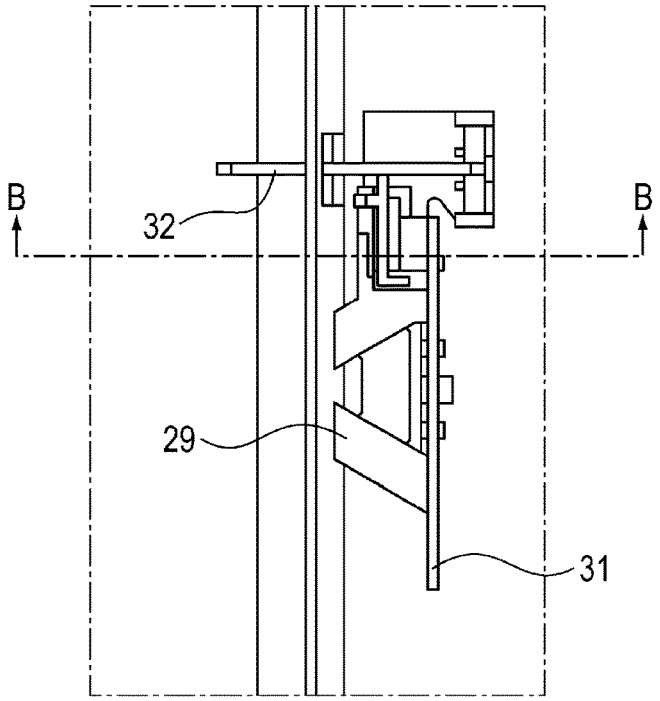
Figure 7:
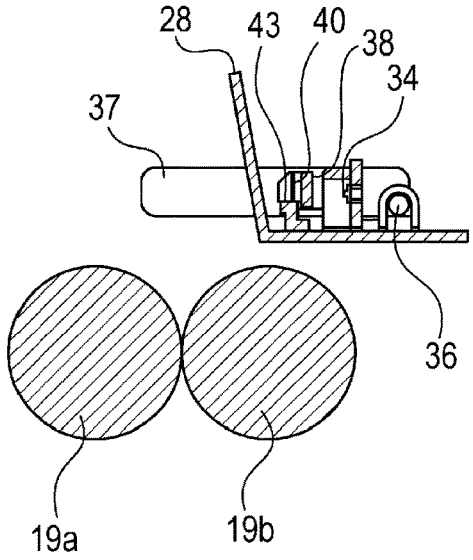

Parts (a) and (b) of FIG. 7 are a combination of top and sectional views of the sheet detecting device when a sheet is absent.

Figure 8:
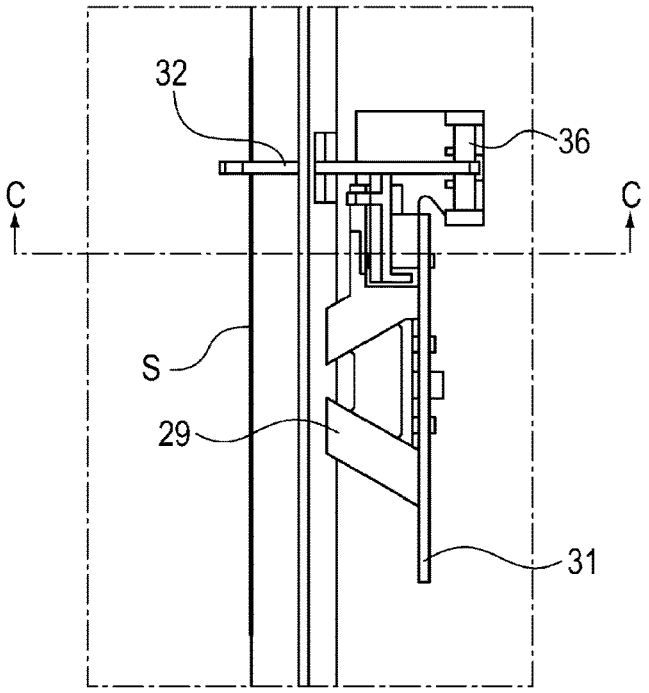
Figure 8:
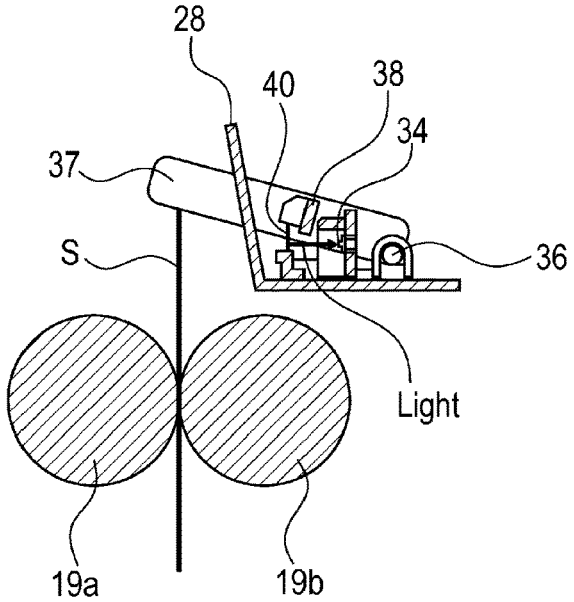

Parts (a) and (b) of FIG. 8 are a combination of top and sectional views of the sheet detecting device when a sheet is present.

Figure 9:
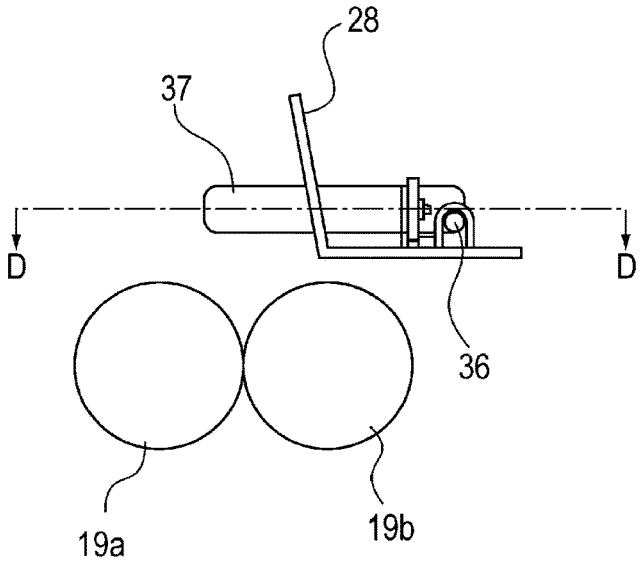
Figure 9:
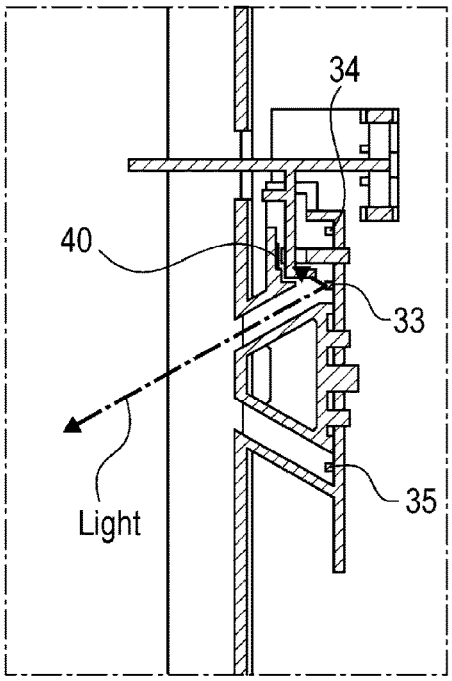

Parts (a) and (b) of FIG. 9 are a combination of top and sectional views of the sheet detecting device when a sheet is absent.

Figure 10:
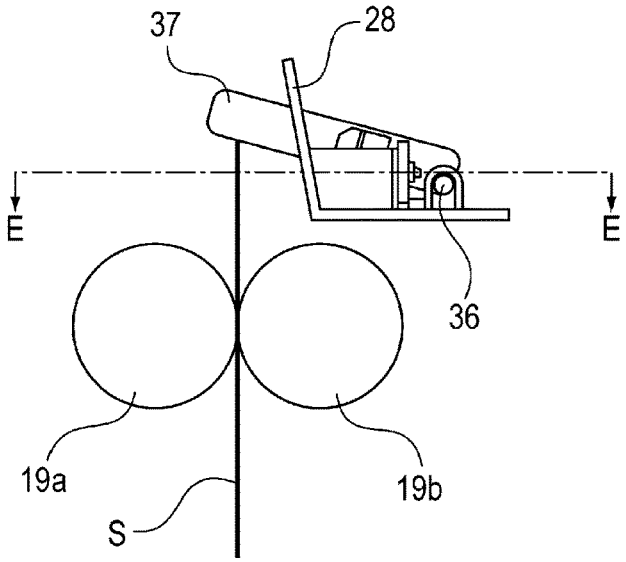
Figure 10:
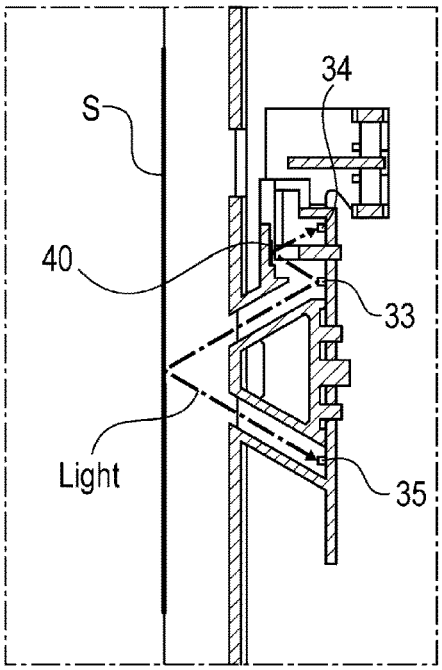

Parts (a) and (b) of FIG. 10 are a combination of top and sectional views of the sheet detecting device when a sheet is present.

Figure 11:
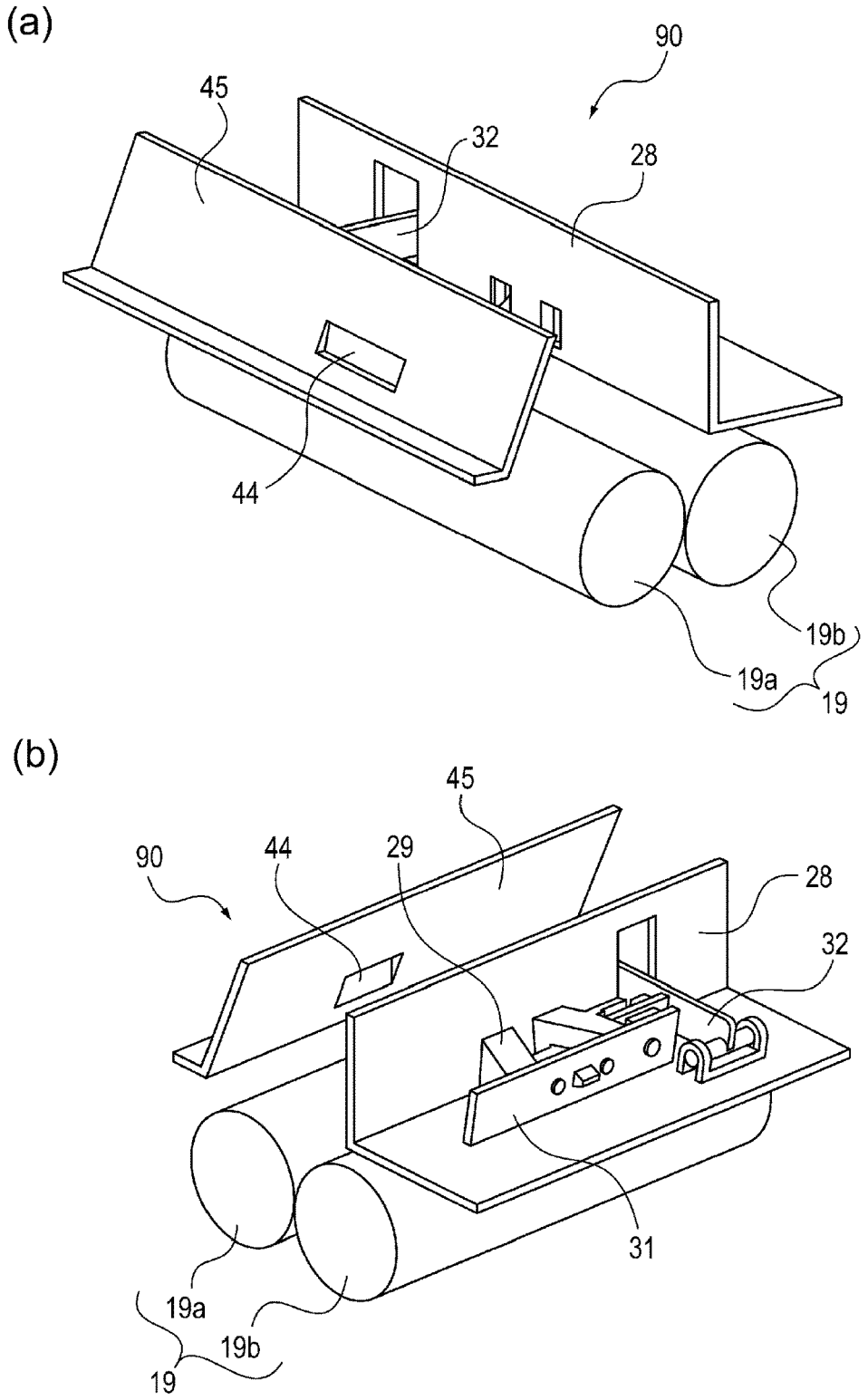

Parts (a) and (b) of FIG. 11 are a schematic sectional view of the sheet detecting device in the second embodiments of the present invention.

Figure 12:
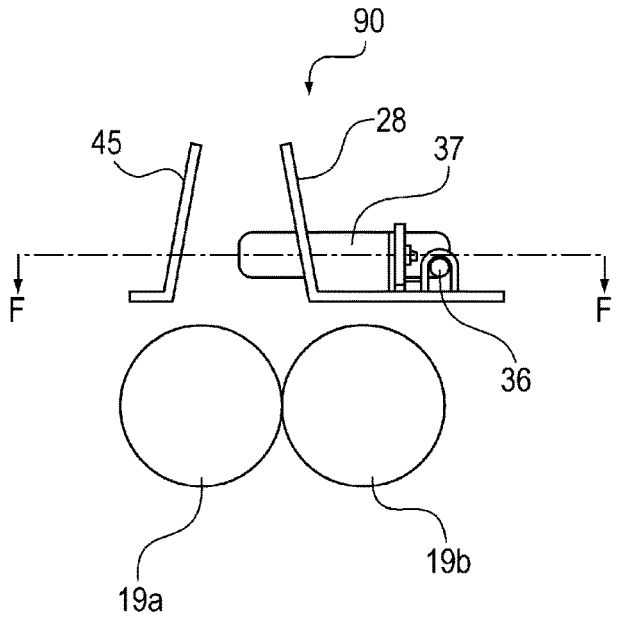
Figure 12:
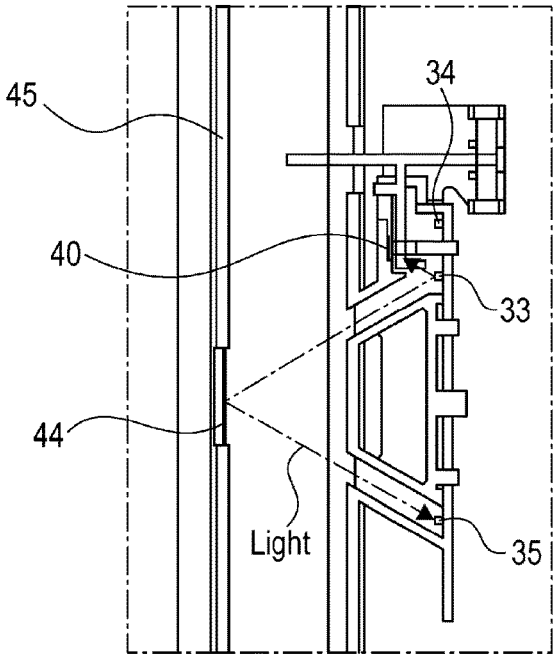

Parts (a) and (b) of FIG. 12 are a combination of top and sectional views of the sheet detecting device in the second embodiment when a sheet is absent.

Figure 13:
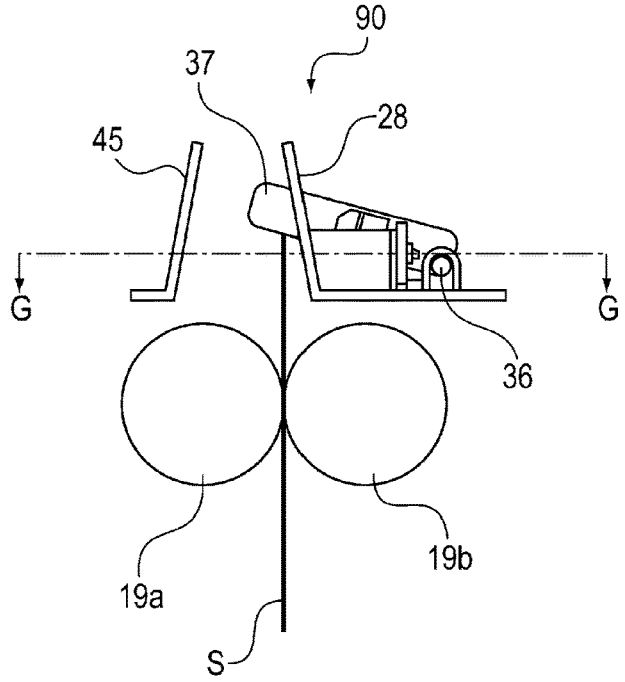
Figure 13:
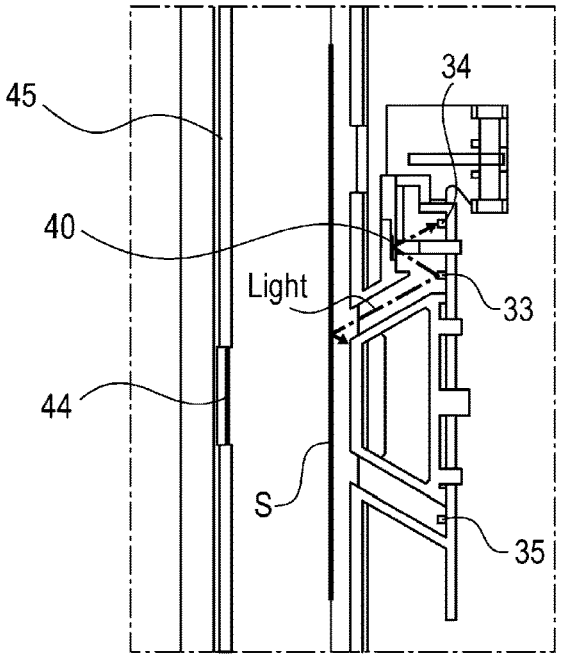

Parts (a) and (b) of FIG. 13 are a combination of top and sectional views of the sheet detecting device in the second embodiment when a sheet is present.

DESCRIPTION OF THE EMBODIMENTS (Embodiment 1)

<Image Forming Apparatus>

To begin with, the overall structure and operation of the image forming apparatus A equipped with a sheet detecting device in the first embodiment of the present invention are described with reference to appended drawings. By the way, the measurements, materials, and shapes of the structural components which will be described hereafter, and the positional relationship among the structural components, are not intended to limit the present invention in scope unless specifically noted.

The image forming apparatus A is a color image forming apparatus of the so-called tandem type, and also, of the so-called intermediary transfer type. It forms a color image by transferring (primary transfer) four toner images which are different in color, more specifically, yellow (Y), magenta (M), cyan (C) and black (K) toner images, onto its intermediary transfer belt, and then, transferring (secondary transfer) the four monochromatic images onto a sheet of recording medium, from the intermediary transfer belt.

Figure 1:
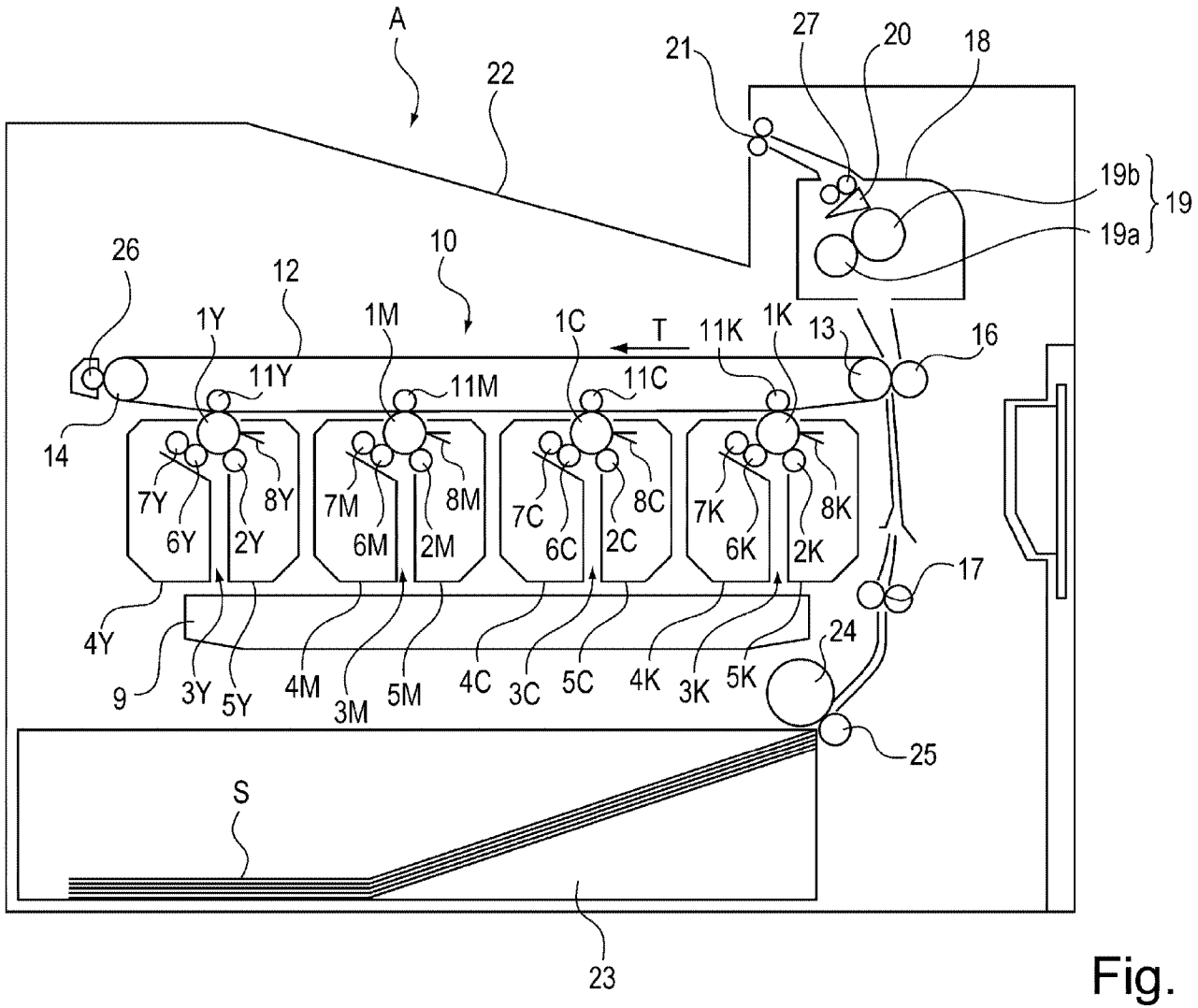
FIG. 1 is a schematic sectional view of a typical image forming apparatus to which the present invention is applicable.

Referring to FIG. 1, the image forming apparatus A has: an image forming portion which transfers toner images onto a sheet of recording medium; a sheet conveying portion which supplies the image forming portion with sheets; and a fixing portion which fixes toner images to the sheet.

A sheet conveying portion has: a sheet cassette 23 which is removably installable in the main assembly of the image forming apparatus A; a sheet conveying portion which supplies a feed roller 24 which feeds a sheet of recording medium into a sheet conveyance passage by being placed in contact with a sheet; a separation roller 25 which separates a sheet of recording medium from the rest in a case where two or more sheets are about to be fed into the sheet conveyance passage.

The feed roller 24 is rotated by the force from an unshown unit for driving the sheet conveying portion. The sheet conveying portion driving unit is fixed to the main assembly of the image forming apparatus A. It is held by unshown front and rear frames. It has a driving mechanism between the two frames, and comprises gears etc.

The image forming portion has: a laser scanner unit 9, an intermediary transfer unit 10, and process cartridges 3 (3Y, 3M, 3C and 3K). By the way, the four process cartridges 3Y, 3M, 3C and 3K are the same in structure although they are different in the color of the toner they use to form yellow (Y), magenta (M), cyan (C) and black (K) toner images, respectively.

Each process cartridge 3 (3Y, 3M, 3C and 3K) is removably installable in the main assembly of the image forming apparatus A. It has a photosensitive member unit 5 (5Y, 5M, 5C and 5K) and a development unit 4 (4Y, 4M, 4C and 4K, respectively).

The photosensitive member unit 5 has a photosensitive drum (1Y, 1M, 1C and 1K), a charge roller 2 (2Y, 2M, 2C and 2K), a cleaning blade 8 (8Y, 8M, 8C and 8K), etc. Further, the development unit 4 has a development roller 6 (6Y, 6M, 6C and 6K), a toner application roller 7 (7Y, 7M, 7C and 7K), etc.

The intermediary transfer unit 10 has a primary transfer roller 11 (11Y, 11M, 11C and 11K), a secondary transfer roller 16, a belt-backing roller 13 (which opposes secondary transfer roller 16), a cleaning apparatus 26, an intermediary transfer belt 12, and a tension roller 14. The intermediary transfer belt 12 is an endless cylindrical belt. It is suspended and kept tensioned by the belt-backing roller 13 and tension roller 14. It is rotated in the direction indicated by an arrow mark T by being driven by the belt-backing roller 13.

The image forming operation of the image forming apparatus A is as follows: As a printing start signal is outputted by an unshown control portion, one of the sheets S of recording medium stored in layers in the sheet cassette 23 is sent to a pair of registration rollers 17 by the feed roller 24. In a case where a sheet S is sent askew to the registration rollers 17, it is corrected in attitude by the registration rollers 17. Then, the sheet S is sent to the image forming portion after being adjusted in timing.

Meanwhile, in the image forming portion, the photosensitive drum 1 is uniformly charged to the preset polarity (negative in this embodiment) by the charge roller 2. Then, the laser scanner unit 9 projects a beam of laser light from its unshown light source while modulating the beam with signals which reflect the information about the image to be formed, upon the peripheral surface of the photosensitive drum 1. Consequently, an electrostatic latent image is effected on the peripheral surface of the photosensitive drum 1. Thereafter, the electrostatic latent image is developed by the development unit 4; toner is adhered to the electrostatic latent image by the development unit 4. As a result, a toner image is formed on the peripheral surface of the photosensitive drum 1.

Then, the four toner images formed on the peripheral surfaces of the photosensitive drums 1, one for one, are transferred (primary transfer) onto the intermediary transfer belt 12 by the primary transfer bias, which is opposite (positive in this embodiment) in polarity from toner and is applied to the primary transfer roller 1.

After the primary transfer of the toner images, the toner images are delivered by the rotation of the intermediary transfer belt 12 to the secondary transferring portion, which is the area of contact between the belt-backing roller 13 and secondary transfer roller 16 which are on the downstream side of the image forming portion in terms of the rotational direction of the intermediary transfer belt 12. In the secondary transferring portion, the toner images on the intermediary transfer belt 12 are transferred onto the sheet by the secondary transfer bias applied to the secondary transfer roller 16.

After the transfer of the toner images onto the sheet S, the sheet S is sent to the fixing apparatus 18, in which the sheet S and toner images thereon are heated and pressed by a pair of fixation rollers 19, that is, a combination of a heat roller 19*a* and a pressure roller 19*b*. Consequently, the toner images are fixed to the sheet S. Thereafter, the sheet S is conveyed further by the pair of exit rollers 27 of the fixing apparatus 18, and then, is discharged into a delivery tray 22 by a pair of discharge rollers 21.

By the way, the toner remaining on the peripheral surface of the photosensitive drum 1 after the primary transfer is removed by the cleaning blade 8. As for the toner remaining on the intermediary transfer belt 12 after the secondary transfer, it is removed by the cleaning apparatus 26.

<Sheet Detecting Device>

Next, a sheet detecting device 20, which is for detecting the presence or absence of a sheet of recording medium in a passage through which the sheet S is conveyed in the main assembly of the image forming apparatus A, is described.

In this embodiment, the sheet detecting device 20 is disposed on the downstream side of the pair of fixation rollers 19. It detects the presence or absence of the sheet S in the sheet passage through which the sheet S is conveyed while remaining pinched by the pair of fixation rollers 19. That is, the pair of fixation rollers 19 are also the sheet conveying means of the sheet detecting device 20. The information regarding the presence or absence of the sheet S detected by the sheet detecting device 20 is conveyed to the unshown control portion, which uses the information received from the sheet detecting device 20 to inform a user of the occurrence of paper jam, and/or control how the sheet S is to be conveyed after coming through the nip between the pair of fixation rollers 19.

<Basic Structure>

Next, the sheet detecting device 20 is described about its basic structure.

FIG. 2 is a schematic perspective view of the sheet detecting device 20. FIG. 3 is a combination of top (part (a) of FIG. 3), side (part (b) of FIG. 3), and sectional (at plane A-A in part (b) of FIG. 3) of the sheet detecting device 20. Referring to FIGS. 2 and 3, the sheet detecting device 20 is fixed to a sheet conveyance guide 28, which is disposed on the downstream side of the pair of fixation rollers 19 in terms of the sheet conveyance direction. More concretely, a sensor holding plate 29 is fixed to the sheet conveyance guide 28, and a substrate 31 is attached to the sensor holding plate 29.

FIG. 4 is a schematic perspective view of the substrate 31. Referring to FIG. 4, the substrate 31 is provided with positioning holes 65 (65*a*, 65*b* and 65*c*) for positioning the sensor holding plate 29 relative to the substrate 31. Further, the substrate 31 has: a light emitting portion 33 which emits light by consuming electric power; a light sensing portion 35 (first light sensing portion) which is for catching and sensing the light emitted from the light emitting portion 33; and a light sensing portion 34 (second light sensing portion). The light sensing portion 35 is of the ordinary type, or the flag-less type. The light sensing portion 34 is of the flag type.

As the light sensing portion 34 of the flag type, and the light sensor 35 of the flag-less type, sense the light emitted from the light emitting portion 33, they convert the light into electrical signals and output the electrical signals. The substrate 31 is provided with an electrical circuit, through which the light emitting portion 33, light sensing portion 34 of the flag type, and light sensing portion 35 of the flag-less type are electrically in connection to the control portion.

FIG. 5 is a schematic perspective view of the sensor holding plate 29. Referring to part (a) of FIG. 5, the sensor holding plate 29 has: a flag holding portion 60 which holds a flag 32; and a substrate holding portion 61 which holds the substrate 31. It has also positioning portions 66 (66*a*, 66*b* and 66*c*) for positioning the substrate 31 by engaging into the positioning holes 65 (66*a*, 66*b* and 66*c*, respectively) of the substrate 31. It has also a reflective member 40 which reflects the light emitted from the light emitting portion 33, toward the light sensing portion 34. Further, it has a stopper 34 which controls the flag 32 in movement.

By the way, the sheet detecting device 20 is structured so that the positioning portions 66 are disposed between the light emitting portion 33 and light sensing portion 34, and between the light emitting portion 33 and light sensing portion 35. Therefore, even if a minuscule gap occurs between the sensor holding plate 29 and substrate 31, it is possible to prevent the light sensing portions from directly catching the light from the light emitting portion 33.

Referring to part (b) of FIG. 5, the sensor holding plate 29 is provided with apertures 30 (30*a*, 30*b*, 30*c* and 30*d*) which guide the light emitted from the light emitting portion 33, toward the sheet conveyance guide 28. More specifically, the apertures 30*a* and 30*b* guide the light emitted by the light emitting portion 33 to the light sensing portion 35 of the optical sensor of the flag type, whereas the apertures 30*c* and 30*d* guide the light emitted by the light emitting portion 33, to the light sensing portion 35 of the optical sensor of the flag-less type. By the way, the sheet conveyance guide 28 is provided with a pair of holes 41*a* and 41*b* (FIG. 2) for the optical sensor, which are positioned so that they coincide with the extension of the third and forth apertures 30*c* and 30*d*, respectively.

FIG. 6 is a schematic perspective view of the flag 32. Referring to FIG. 6, the flag 32 has an axle 35 and a sheet contacting portion 37. It is attached to the flag holding portion 60 of the sensor holding plate 29, by its axle 36 so that it is allowed to pivotally move about the axle 36. The sheet contacting portion 37 (movable portion) is in connection to the axle 36. As a sheet S of recording medium comes into contact with the sheet contacting portion 37, the sheet contacting portion 37 is pivotally moved about the axle 36 by the sheet S.

Further, the sheet contacting portion 37 is long enough to extend through a flag hole 39 (FIG. 2), with which the sheet conveyance guide 28 is provided, and into the area through which the sheet S is conveyed. Further, the flag 32 is provided with a light blocking portion 38, which is on one of the lateral surfaces of the sheet contacting portion 37. Thus, the control portion controls the sheet detecting device 20 in such a manner that as the sheet contacting portion 37 is pivotally moved, the light blocking portion 38 allows the light which came through the apertures 30*a* and 30*b*, to pass, or blocks the light, in order to allow the light emitted from the light emitting portion 33, to enter the light sensing portion 34 of the optical sensor of the flag type only when the sheet contacting portion 37 is in contact with the sheet S. Further, the sensor holding plate 29 is provided with a recess, which coincides with the path through which the light blocking portion 38 of the flag 32 moves as the sheet contacting portion 37 is pivotally moved.

<Detecting Operation>

Next, how the presence of the sheet S is detected by the sheet detecting device 20 is described.

The sheet detecting device 20 detects the presence or absence of the sheet S with the use of a combination of the ordinary optical sensor (first sheet detecting means; sensor of flag-less type), and the optical sensor of the flag type (second sheet detecting means). The optical sensor of the flag type comprises the light emitting portion 33, flag 32, light sensing portion 34, control portion, etc. The flag-less sensor comprises the light emitting portion 33, light sensing portion 35, control portion, etc.

FIG. 7 is a combination of a top view (part (a) of FIG. 7) of the sheet detecting device 20, and a sectional view (part (b) of FIG. 7) of the sensing portion of the optical sensor of the flag type, at a plane B-B in part (a) of FIG. 7, when the sheet S is absent. Referring to FIG. 7, when the sheet S is absent, the sheet contacting portion 37 of the flag 32 is prevented from rotationally moving, by the stopper 43 of the sensor holding plate 29. When the sheet detecting device 20 is in this state, the light blocking portion 38 blocks the light deflected by the reflecting member 40 for the optical sensor of the flag type. Thus, no light enters the light sensing portion 34 of the optical sensor of the flag type, and therefore, electrical signals are not outputted from the light sensing portion 34 of the optical sensor of the flag type. In this embodiment, it is when no electric signal is outputted from the light sensing portion 34 of the optical sensor of the flag type that the control portion determines that the sheet S is absent.

FIG. 8 is a combination of a top view (part (a) of FIG. 8) of the sheet detecting device 20, and a sectional view (part (b) of FIG. 8) of the light sensing portion of the optical sensor of the flag type, at a plane C-C in part (a) of FIG. 8, when the sheet S is present. Referring to FIG. 8, when the sheet S is present, the sheet S comes into contact with the sheet contacting portion 37 of the flag 32, and makes the sheet contacting portion 37 upwardly pivot. At the same time, the light blocking portion 38, which is a part of the sheet contacting portion 37, is also made to upwardly pivot, being thereby prevented from blocking the light outputted from the light emitting portion 33; a passage is created for the light from the light emitting portion 33. Thus, the light deflected by the reflective member 40 for the optical sensor of the flag type enters the light sensing portion 34 of the optical sensor of the flag type, and causes electric current to flow in the light sensing portion 34. In this embodiment, it is when electric current is being induced in the light sensing portion 34 of the optical sensor of the flag type, and therefore, electric signals are being outputted, that the control portion determines that the sheet S is present.

FIG. 9 is a combination of a side view (part (a) of FIG. 9) of the sheet detecting device 20, and a sectional view of the sheet detecting device 20 at a plane D-D in part (a) of FIG. 9, when the sheet S is absent. Referring to FIG. 9, when the sheet S is absent, there is no object that reflects the light from the light emitting portion 33. Therefore, the light does not reach the light sensing portion 35 of the optical sensor of the flag type. Therefore, electric signals are not outputted from the light sensing portion 35 of the sensor of the ordinary type, or the flag-less type. In this embodiment, it is when electric signals are not being outputted from the light sensing portion 35 of the optical sensor of the flag-less type that the control portion determines that the sheet S is absent.

FIG. 10 is a combination of a side view (part (a) of FIG. 10) of the sheet detecting device 20, and a sectional view (part (b) of FIG. 10) of the sheet detecting device 20 at a plane E-E in part (a) of FIG. 10, when the sheet S is present. Referring to FIG. 10, when the sheet S is present, the light from the light emitting portion 33 is reflected by the surface of the sheet S, and enters the light sensing portion 35 of the optical sensor of the flag-less type. Therefore, electric current is induced in the light sensing portion of the optical sensor of the flag-less type. In this embodiment, it is when electric current is being induced in the light sensing portion 35 of the optical sensor of the flag-less type, and therefore, electric signals are being outputted, that the control portion determines that the sheet S is present.

As described above, in a case where a sheet interval is very small or in the like cases, the flag 32 of the optical sensor of the flag type fails to return from the position in which a sheet is detected by the flag, to the position (which hereafter will be referred to as "standby position") in which it remains on standby to detect the sheet S. Thus, the optical sensor of the flag type sometimes suffers from the issues related to the response time of the flag. On the other hand, when it is necessary to detect a sheet of recording medium, through which light can easily transmit, the amount by which light reaches the light sensing portion 35 of the optical sensor of the flag-less type after being reflected by the sheet is relatively small. Thus, it is possible that the amount by which electric current from the light sensing portion 35 of the optical sensor of the flag-less type will fail to exceed the threshold value related to the electric signal and set in advance by the control portion, and therefore, it is possible that the presence or absence of the sheet S will not be accurately detected.

Thus, the control portion determines the sheet type, based on the sheet type selection made by a user or an unshown media sensor disposed, as discriminating means, in the image forming apparatus A. Then, based on this determination, it selects the optical sensor of the flag type or flag-less type to determine whether or not the sheet S is present.

That is, if it is determined by the discriminating means that it is a sheet of transparency for a OHP that is being conveyed, the control portion uses the optical sensor of the flag type to detect the presence or absence of the sheet S. In such a case, the distance between the trailing edge of a sheet of transparency for an OHP and the leading edge of the immediately following sheet S is set to be greater than the length of time it takes for the sheet contacting portion 37 of the flag 32 to from the detecting position to the standby position.

On the other hand, if it is determined by the discriminating means that a sheet S of recording medium, which is being conveyed, is a sheet of ordinary paper, it is the optical sensor of the flag-less type that is used to detect the presence or absence of the sheet S. In such a case, the sheet interval is set to be greater than the minimum value that makes it impossible for the light from the light emitting portion 33 to reach the light sensing portion 35 of the optical sensor of the flag-less type through the sheet gap, that is, without being reflected. By the way, if a sensor of the flag-less type is used to detect the presence or absence of a sheet S of ordinary paper, the sheet interval is large enough for the sheet contacting portion 37 of the flag 32 to return from its detecting position to its standby position. Therefore, as long as a sheet S of ordinary paper is conveyed, the electric signals from the optical sensor of the flag type always indicates the presence of the sheet.

As described above, in this embodiment, the optical sensor of the flag type, and the optical sensor of the flag-less type, are used in combination. Therefore, it is possible to accurately detect the presence or absence of a sheet of recording medium, regardless of recording medium type.

Further, the sheet detecting device 20 is configured so that the light which is to be sensed by the light sensing portion 35 of the optical sensor of the flag-less type, and the light which is to be sensed by the light sensing portion 33 of the optical sensor of the flag type, are emitted by a single light source, that is, the light emitting portion 33. Therefore, the sheet detecting device 20 in this embodiment is smaller in the amount of space necessary for the light source than a sheet detecting device (20) configured to use two light sources. That is, the present invention can reduce a sheet detecting device in size and electric power consumption.

That is, the present invention can provide a sheet detecting device 20 which is capable of accurately detect the presence or absence of a sheet of recording medium regardless of recording medium type, and which is smaller in size and electric power consumption than any conventional sheet detecting device.

(Embodiment 2)

Next, the second embodiment of the image forming apparatus A which is in accordance with the present invention is described with reference to the drawings. The portions of the image forming apparatus A in this embodiment, the description of which are the repetition of the description of the counterparts in the first embodiment, are given the same referential codes as those given to the counterparts, and are not described.

One of the methods for increasing an image forming apparatus and a sheet detecting device in durability is to increase their light emitting portions in durability. In order to increase the light emitting portion in durability (total length of time it can emit light), it is necessary to reduce the light emitting portion in the amount by which it is required to emit light. Further, in a case where an LED is used as the light source, the durability of the light source is dependent upon temperature. Thus, in a case where a sheet detecting device is disposed close to the heat source of a fixing apparatus, the sheet detecting device (light source) is less durable than in a case where the sheet detecting device (light source) is used at room temperature. Thus, it is desired that the light source of a sheet detecting device is minimized in the amount by which it is required to emit light.

However, in a case where a sheet detecting device is structured so that the light from a single light source is sent to multiple light sensing portions, the amount of the light which each light sensing portion catches is reversely proportional of the number of the light sensing portions. Thus, if the light emitting portion is reduced in the amount of light, it is possible that the amount by which each light sensing portion catches light will not be large enough for the electric current outputted by the light sensing portion to be large enough to exceed the threshold value set by the control portion. That is, reflectivity of a sheet of recording medium is affected by the type of the surface of the sheet. Thus, in a case where a sheet S of recording medium of a certain type is used, it is possible that the sheet S will not reflect light by a sufficient amount, and therefore, the light sensing portion will not be able to catch a sufficient amount of light. Therefore, it is possible that a sheet detecting device, in particular, an optical sensor, such as the one in the first embodiment, which catches the light from the light source after the light is reflected (deflected) by a sheet S of recording medium, will fail to detect the presence of the sheet S.

In the following sections, therefore, the sheet detecting device in this embodiment, which also is less in size and electric power consumption, more durable, and yet, can more accurately detect the presence of each sheets of various types than any conventional sheet detecting device, is described.

FIG. 11 is a schematic perspective view of the sheet detecting device 90 in this embodiment. Referring to FIG. 11, in this embodiment, a reflective member 44 is disposed on the opposite side of the sheet conveyance area from the light emitting portion 33. Otherwise, the sheet detecting device 90 in this embodiment is roughly the same in structure as the sheet detecting device 20 in the first embodiment.

The reflective member 44 is fixed to a reflective member holding member 45. It reflects the light emitted from the light emitting portion 33, toward the light sensing portion 35 of the optical sensor of the flag-less type. All that is required of the reflective member 44 is that it can reflect light. For example, it may be a mirror, or a piece of plate of shinny metal or resin. Here, "toward the light sensing portion 35 of the sheet detecting portion of the flag-less type" means not only "directly toward the light sensing portion 35", but also, "indirectly toward the light sensing portion 35", that is, "toward another reflective means which deflect the light toward the light sensing portion 35".

Next, the sheet detecting operation of the sheet detecting device 90 is described. By the way, how the presence or absence of a sheet S of recording medium is detected by the sensor of the flag type of the sheet detecting device 90 is the same as the one in the first embodiment. Here, therefore, only the sheet detecting operation of the optical sensor of the flag-less type is described.

FIG. 12 is a combination of a side view (part (a) of FIG. 12) of the sheet detecting device 90, and a sectional view of the sheet detecting device 90 at a plane F-F in part (a) of FIG. 12, when no sheet S of recording medium is present. Referring to FIG. 12, when the sheet S is absent, the light emitted from the light emitting portion 33 is reflected by the reflective member 44, and enters the light sensing portion 35 of the optical sensor of the flag-less type, inducing thereby electric current in the light sensing portion 35. In this embodiment, it is when the sheet detecting device 90 in the state in which electric current is being induced in the light sensing portion 35, and therefore, electric signals are being outputted, that the control portion determines that the sheet S is absent.

By the way, the optical sensor of the flag-less type may be structured so that light is emitted perpendicular to a sheet S, and also, so that the reflective member 44 is structured to reflect (deflect) the light twice so that the light comes out of the reflective member 44 in the direction which is perpendicular to the sheet S. This structural arrangement, however, is problematic for the following reason. That is, if a sheet S becomes jammed in the image forming apparatus A, it is necessary to expose the adjacencies of the sheet detecting device to make it easier for a user to remove the jammed sheet S. Thus, some image forming apparatuses are structured so that their sheet conveyance guide and reflective member holding member 45 are movable, being therefore greater in component count, and less accurate in the positioning of the sheet conveyance guide 28 and reflective member holding member 45, than an image forming apparatus, the sheet conveyance guide and reflective member holding member of which are immovable. These image forming apparatuses, therefore, are desired to be structured so that the light from the light emitting portion 33 is reflected only once by the reflective member 44 like the one in the sheet detecting device 90 in this embodiment. With the sheet detecting device being structured so that the light from the light emitting portion 33 is reflected only once, it is smaller in the amount of deviation in the angle of reflection. Therefore, even if the sheet conveyance guide 28 and reflective member holding member 45 are movable, it is possible to keep the sheet detecting device reliable.

Further, in a case where the sheet detecting device is structured so that the light from the light emitting portion 33 is reflected twice, the reflective member 44 has to be like a right angled prism, being therefore relatively greater in dimension in terms of the direction perpendicular to the direction in which light is emitted by the light emitting portion. On the other hand, in a case where the sheet detecting device is structured so that the light from the light emitting portion 33 is reflected only once, the reflective member 44 may be in the form of a piece of thin plate to contribute to the size reduction of the apparatus.

FIG. 13 is a combination of a side view (part (a) of FIG. 13) of the sheet detecting device 90, and a sectional view (part (b) of FIG. 13) of the sheet detecting device 90, at a plane G-G in part (a) of FIG. 13, when a sheet S is present. Referring to FIG. 13, as a sheet S is conveyed through the area between the sheet conveyance guide 28 and reflective member 44, the sheet S blocks the light emitted from the light emitting portion 33 toward the reflective member 44. The sheet detecting device 90 in this embodiment is structured so that as the light from the light emitting portion 33 is blocked by the sheet S, it is reflected by the surface of the sheet S, and hits the sheet conveyance guide 28, in order to alleviate the problem that if a sheet detecting device is not structured so that light is not emitted perpendicular to the surface of a sheet S as in this embodiment, the light tends to enter the light sensing portion 35 of the optical sensor of the flag-less type. With the employment of this structural arrangement, it is possible to prevent the sensor from making a sheet detection error. More concretely, with the employment of this structural arrangement, when the sheet detecting device 90 is in the state in which a sheet S is present, the light emitted from the light emitting portion 33 does not reach the light sensing portion 35 of the optical sensor of the flag-less type, and therefore, the apparatus remains in the state in which electric current does not flow in the light sensing portion. In this embodiment, it is when the sheet detecting device 90 is in the state in which electric current is not flowing in the light sensing portion 35 of the optical sensor of the flag-less type, and therefore, electric signals are not being outputted, that the control portion determines that the sheet detecting device 90 is in the state in which a sheet S is present.

By the way, in FIGS. 12 and 13, the light reflected by the reflective member 44, and the light reflected by a sheet S, are indicated by straight lines. In reality, however, certain portions of the light from the light emitting portion 33 are irregularly reflected. However, the amount by which the light is irregularly reflected is very small compared to the amount by which the light is normally reflected. That is, it is not large enough to cause the light sensing portion 35 to output such electric signals that are strong enough to exceed the threshold value set by the control portion.

As described above, by structuring the sheet detecting device 90 so that the light outputted from the light emitting portion 33 enters the light sensing portion 35 of the optical sensor of the flag-less type after being reflected by the reflective member 44, it is possible to efficiently reflect the light emitted from the light emitting portion 33, regardless of sheet type. Therefore, it is possible to provide a sheet detecting device which is significantly smaller in the amount by which its light emitting portion 33 emits light, and yet, is significantly superior in terms of the response and reliability of its optical sensor than any conventional sheet detecting device. That is, the present invention can improve a sheet detecting device which employs optical sensors, in responsiveness and reliability, while reducing the light emitting portion in the amount of light output. Thus, the present invention can provide a sheet detecting device which is significantly smaller in size and electric power consumption, more durable, and yet, can more accurately detect the presence or absence of a sheet of recording medium, regardless of recording medium type, than any conventional sheet detecting device.

By the way, in the first and second embodiments described above, the light emitting portion 33, light sensing portion 34 of the optical sensor of the flag type, and light sensing portion 34 of the optical sensor of the flag-less type are disposed on a single substrate, that is, the substrate 31. However, the first and second embodiments are not intended to limit the present invention in scope in terms of the number of substrate count. That is, a sheet detecting device may be provided with two or more substrates (31). However, the greater a sheet detecting device is in substrate count, the greater the space necessary for the connectors for the wiring, and so, is the number of steps necessary to assemble the apparatus. Thus, from the standpoint of minimizing the space necessary for the connectors, and the efficiency with which the apparatus can be assembled, it is desired that the apparatus is designed so that these components are attached to a single substrate.

The light emitting portion 33 is an electronic component which consumes electricity to output light. Thus, it is desired that an LED (light emitting diode), which is based on electro-luminescence and is significantly smaller in electric power consumption than an incandescent light source, is used as the light source. Further, regarding the mounting of an LED on the substrate 31, by employing a surface-mountable LED instead of an LED shaped like a bullet, it is possible to reduce a sheet detecting device in the space necessary for the light source (LED).

Further, regarding the reflective member 40 or reflective member 44 for the optical sensor of the flag type, the sensor holding plate 29 may be formed of a metallic or resinous substance, as an integral part of the reflective member 44 for the optical sensor of the flag type. Further, the reflective member holding member 45 may be formed of a metallic resinous substance, as an integral part of the reflective member 44. That is, all that is required of a sheet detecting device is that it is structured so that the light from the light emitting portion 33 is reflected at the position of the reflective members 40 and 44 for the optical sensor of the flag type. Moreover, it is not mandatory that the reflective member 40 for the optical sensor of the flag type is disposed in the sheet conveyance guide 28.

Further, in the first and second embodiments described above, the sheet conveyance guide 28 is provided with the hole 41 for the optical sensor of the flag-less type, so that the sheet detecting device 20 (90) can be disposed on the opposite side of the sheet conveyance area from the sheet conveyance guide 28. However, the sheet detecting device 20 (90) is disposed in the adjacencies of the fixing apparatus 18. Therefore, it is desired that the image forming apparatus A is structured to minimize the effect of the heat from the fixing apparatus 18 upon the light emitting portion 33, light sensing portion 34 of the optical sensor of the flag type, and light sensing portion 35 of the optical sensor of the flag-less type. Thus, the sheet detecting device may be changed in the positioning of the sensors so that the sheet conveyance guide 28 does not need to be provided with the hole.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-182725 filed on Sep. 20, 2016, which is hereby incorporated by reference herein in its entirety.

What is claimed is:

1. A sheet detecting device usable with a sheet feeding device for feeding a sheet, said sheet detecting device comprising:

a common light emitter;

a first light receptor and a second light receptor configured to receive the light emitted by said common light emitter and output a signal in response to the reception of the light;

a first sheet detector configured to detect presence or absence of the sheet by switching the signal outputted by said first light receptor, in response to the sheet blocking or reflecting the light emitted by said common light emitter;

a movable portion capable of being moved by the sheet which is moving; and a second sheet detector configured to detect presence or absence of the sheet by switching the signal outputted by said second light receptor, in response to said movable portion forming or blocking an optical path for the light emitted by said common light emitter.

2. A device according to claim 1, further comprising a reflector provided opposed to said light emitter with a sheet feeding region of the sheet feeding device interposed between said reflector and said light emitter, said reflector being configured to reflect the light emitted by said light emitter toward said first light receptor.

3. A device according to claim 1, wherein said first light receptor, said second light receptor and said light emitter are provided on a common base plate.

4. A device according to claim 1, further comprising controller configured to control said first sheet detector and said second sheet detector, wherein said controller causes either of said first sheet detector or said second sheet detector to detect the presence or absence of the sheet depending on a kind of the sheet.

5. An image forming apparatus comprising:

a sheet feeding device configured to feed a sheet along a sheet feeding path;

a sheet detecting device according to claim 1 configured to detect the sheet in the sheet feeding path; and an image forming portion configured to form an image on the sheet.

* * * * *